US006664491B2

(12) United States Patent
Yanai et al.

(10) Patent No.: US 6,664,491 B2
(45) Date of Patent: Dec. 16, 2003

(54) PUSH SWITCH

(75) Inventors: Yasunori Yanai, Okayama (JP); Hisashi Watanabe, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/277,314

(22) Filed: Oct. 22, 2002

(65) Prior Publication Data

US 2003/0094359 A1 May 22, 2003

(30) Foreign Application Priority Data

Oct. 29, 2001 (JP) ..... 2001-330448

(51) Int. Cl.[7] ..... H01H 13/00

(52) U.S. Cl. ..... 200/516; 200/512; 200/406; 200/341

(58) Field of Search ..... 200/16 R–16 D, 200/406, 512, 516, 517, 341

(56) References Cited

U.S. PATENT DOCUMENTS 5,172,114 A * 12/1992 Bedoya et al. ..... 341/27
5,772,010 A * 6/1998 Watanabe et al. ..... 200/406
5,939,690 A * 8/1999 Yasui et al. ..... 200/302.2
6,271,487 B1 * 8/2001 Domzalski et al. ..... 200/1 B
6,489,580 B2 * 12/2002 Yanai et al. ..... 200/406

FOREIGN PATENT DOCUMENTS

JP 3-214519 9/1991 ..... H01H/13/20

* cited by examiner

*Primary Examiner*—Michael Friedhofer
(74) *Attorney, Agent, or Firm*—RatnerPrestia

(57) ABSTRACT

In a switch, an elastic member made of elastic material includes a bar section, a conical section at its upper portion functioning as a first deforming section, and a second deforming section at its lower portion. A movable contact in a switch case is pushed with the lower end portion of the second deforming section. A bar section of an elastic element projects through a central hole of a cover fixed to the switch case. In this switch, a pushing force applied to the elastic element deforms the first deforming section elastically, and then the second deforming section deforms elastically, and thus, the switch operates. The switch can absorb fluctuations due to combination of components of an electronic appliance, and stabilize its manipulation feeling through eliminating looseness of an operation button of the appliance.

13 Claims, 15 Drawing Sheets

PUSH SWITCH

FIELD OF THE INVENTION

The present invention relates to a small push switch used in various electronic appliances.

BACKGROUND OF THE INVENTION

In the recent trend of smaller size and higher quality for electronic appliances, push switches and other electronic components are desired to be small, thin, and to generate clear handling feeling. A push switch having a longer operation stroke is demanded.

A configuration of a conventional push switch disclosed in Japanese Laid-open Patent No.3-214519 will be explained, referring to FIG. 14 and FIG. 15.

FIG. 14 is a front sectional view of a conventional push switch 5. In the bottom of a switch case 1 of molded resin box, two outside fixed contacts 2 coupled to a connection terminal 2A and a central fixed contact 3 coupled to a connection terminal 3A are fixed by insert molding. A movable contact 4 of elastic thin metal is disposed on the two outside fixed contact points 2.

The movable contact point 4 is made of elastic thin metal plate, and includes a ring-shaped periphery 4C and a tongue 4A extending from the periphery 4C toward its center. The tongue 4A is folded in an upward slope at a junction 4B with the periphery 4C. The periphery 4C of the movable contact 4 is disposed on the outside fixed contacts 2 to contact with the contacts 2 electrically. The tongue 4A in the center faces the central fixed contact 3 in this arrangement, providing a switch contact.

An elastic element 6 is made of rubber or other elastic material, and has a columnar bar section 6B at its upper part, and a thin conical section 6D at its lower part. A drooping section 6C projecting downward from a inside central part of the conical section 6D faces the tongue 4A of the movable contact 4 at a certain gap. An outer lower end 6A of the conical section 6D is disposed on the top of the periphery 4C of the movable contact 4.

An operation element 7 is disposed on the bar section 6B. The periphery of a lower part 7A of the operation element 7 is regulated by the inner periphery of a wall 1A of the switch case 1, thus allowing the operation element 7 to move up and down without inclination.

Two protrusions 7B on the periphery are engaged with upper and lower grooves 1B provided in the inner periphery of the wall 1A of the switch case 1, respectively. The operation element 7 is locked so as not to rotate or slip out upward. A protrusion 7C projecting upward from the switch case 1 is an operation part.

An operation of the push switch 5 will be explained below.

The protrusion 7C of the operation element 7 is pushed during the switch being turned off as shown in FIG. 14, and then, the operation element 7 pushes the elastic element 6 in the switch case 1. This operation deforms the conical section 6D of the elastic element 6, and generates a clear click feel at the time of the deformation. Simultaneously, the drooping section 6C of the elastic element 6 pushes down the tongue 4A into the center of the movable contact 4, and the lower side of the tongue 4A contacts with the central fixed contact 3. And the outside fixed contacts 2 and the central fixed contact point 3, that is, the two connection terminals 2A and 3A then conduct with each other.

Then, when a pushing force to the operation element 7 is removed, the elastic element 6 and movable contact 4 return to an initial state with their own elastic restoring force, and the two connection terminals 2A and 3A opens again.

The push switch 5 installed in an electronic appliance will be explained. FIG. 15 is a front view of a conventional push switch installed in an electronic appliance. The push switch 5 is disposed on a wiring board 8 with the connection terminals 2A and 3A connected electrically at the lower side by, e.g. soldering, and is placed immediately beneath an operation button 9 fitted to a case 10 of the appliance corresponding to the position of the operation element 7.

The interval between the lower side of the operation button 9 and the upper side of the wiring board 8 is determined according to the height of the push switch 5.

In the conventional push switch 5, however, due to fluctuations of components and their combination in the electronic appliance including the switch, or to an installing state of the push switch 5, it is difficult to set the interval between the lower side of the operation button 9 and the upper side of the wiring board 8 to be the height of the push switch 5. If the interval is too wide, a gap between the operation button 9 and the upper side of the push switch 5 makes the operation button 9 loose. If the interval is too narrow, on the other hand, the operation button slightly pushes the operation element 7 of the push switch 5, and this makes the sensation of manipulation of the push switch 5 dull.

SUMMARY OF THE INVENTION

The push switch can absorb fluctuations of components and their combination of an electronic appliance, and is prevented from looseness in an operation button of the electronic appliance including the switch, thus maintaining a clear manipulation feeling.

DESCRIPTION OF THE PREFERRED EMBODIMENTS (Exemplary Embodiment 1)

Figure 1:
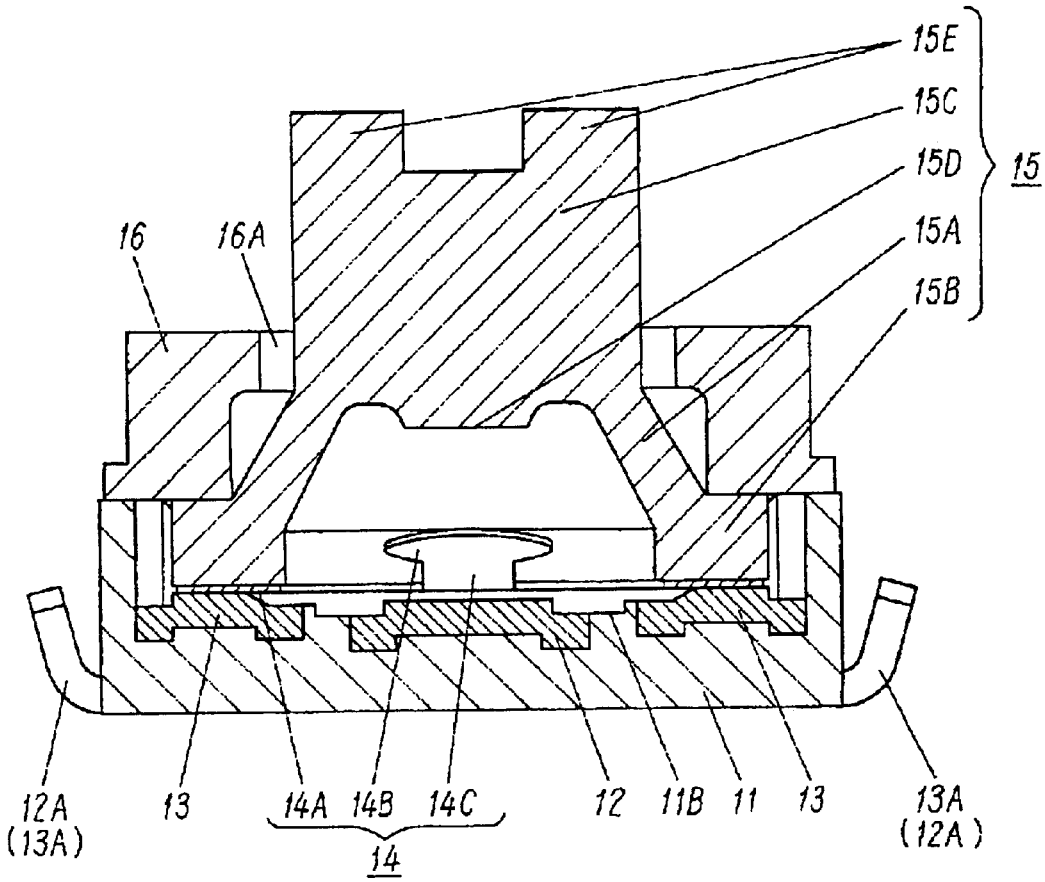
FIG. 1 is a front sectional view of a push switch according to a first exemplary embodiment of the present invention.
Figure 2:
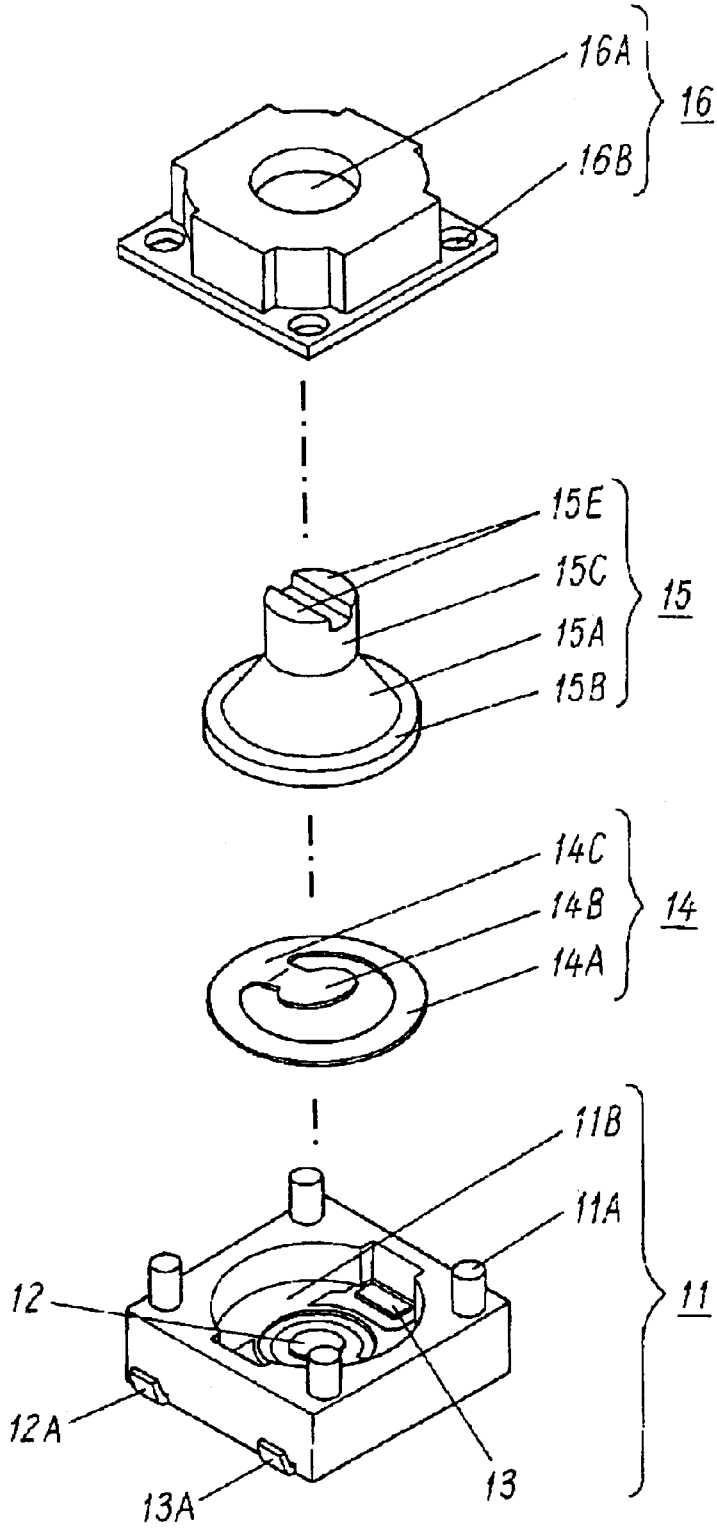
FIG. 2 is a perspective exploded view of the push switch according to the first embodiment.

FIG. 1 is a front sectional view of a push switch according to a first exemplary embodiment of the present invention, and FIG. 2 is an exploded perspective view of the switch.

In an inner bottom 11B of a resin-made switch case 11 of a box shape, a central fixed contact 12 and two outside fixed contacts 13 are disposed at symmetrical positions thereof being fixed by insert molding. The contacts are exposed nearly at the same heights. Connection terminals 12A and 13A communicating with the fixed contacts 12 and 13, respectively, are drawn out of a side wall of the case. A columnar crimping protrusion 11A is provided on an upper side of the switch case 11. A movable contact 14 made of elastic thin metal plate includes a periphery 14A of a circular ring shape, a tongue 14B provided in the center of the contact, and a linkage 14C linking the periphery 14A and the tongue 14B. The tongue 14B is folded with an upward inclination at the linkage 14C. In the movable contact 14, the periphery 14A is mounted on the outside fixed contact 13 on the switch case 11. The tongue 14B faces the central fixed contact 12 at a certain interval.

An elastic element 15 made of elastic insulating material includes an upward bar section 15C and a conical section of a thin wall opening downward both being formed integrally in its lower part. A straight groove is provided in the center of the upper side of the bar section 15C, and the other portion functions as a first deforming section 15E. The conical section disposed in the lower part of the bar section 15C functions as a second deforming section 15A. The conical section as the second deforming section 15A includes a drooping section 15D projecting downward in its inside.

The elastic element 15 has its lower end portion 15B of conical section disposed on the periphery 14A of the movable contact 14, and the movable contact 14 electrically conducts with the outside fixed contact 13 at its downward side.

When the first deforming section 15E pushes the elastic element 15 down to deform, the first deforming section 15E deforms by compressing elastically, and then, the second deforming section 15A, i.e., a conical section of a thin wall buckles and deforms. That is, the width and depth of the groove are determined, so that a force for deforming the first deforming section 15E may be smaller than a force for deforming the second deforming section 15A.

A cover 16 has a box shape opening downward, and has a central hole 16A in the center of its upper side. A crimping bump 11A on the upper side of the switch case 11 is inserted in a crimping hole 16B formed in a downward flange surface, and the upper part of crimping bump 11A is crushed to be crimped, and is fixed to the switch case 11.

While the cover 16 is fixed, the bar section 15C of the elastic element 15 projects upward from the central hole 16A, and the upper side of the lower end portion 15B of the elastic element 15 is pushed to contact elastically with the periphery 14A of the movable contact 14 at the lower end side of the cover 16. An elastic force maintains a stable electrical conduction of the lower side of the periphery 14A and the outside fixed contact 13. The elastic force holds the elastic element 15 so as not to rotate or slip out upward.

An operation of the push switch will be explained.

Figure 3:
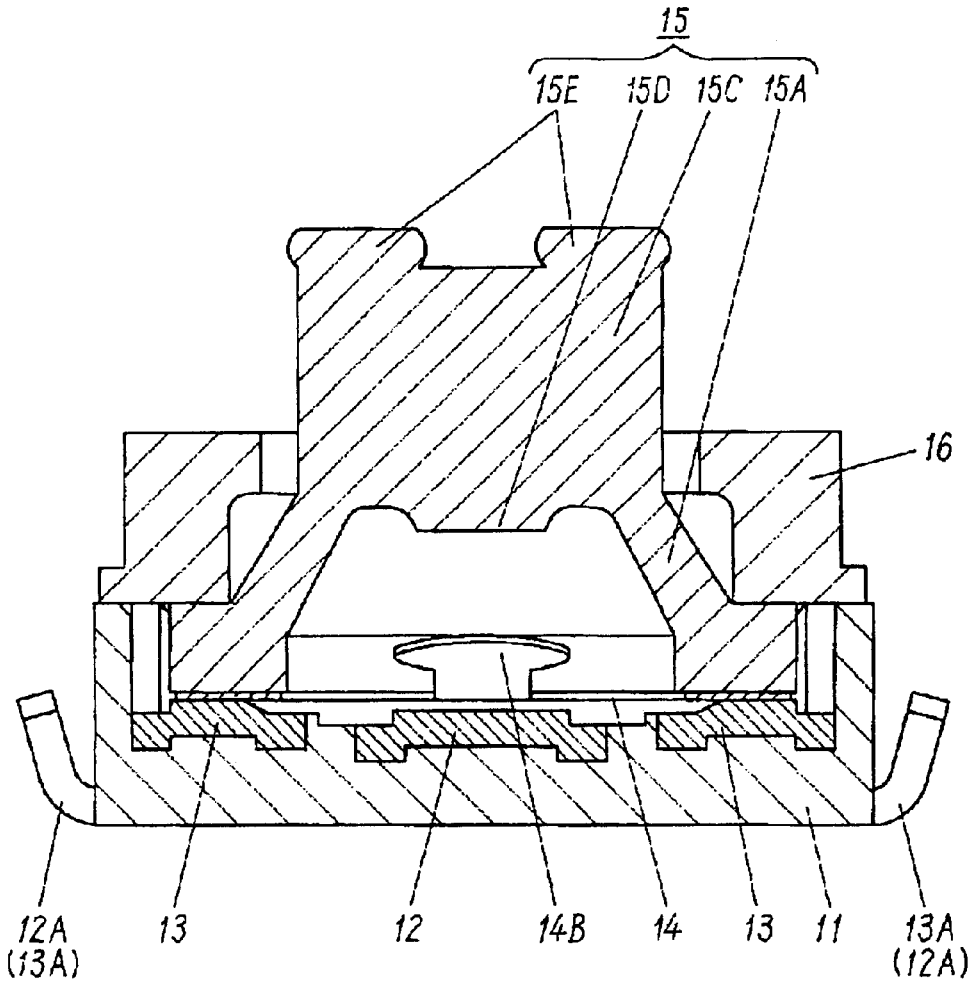
FIG. 3 is a front sectional view of the push switch according to the first embodiment.

In case that the switch is turned off, as shown in FIG. 1, when the elastic element 15 is pushed down, only the first deforming section 15E of the upper part of the elastic element 15 deforms elastically as shown in FIG. 3. The deformation corresponds to a first deforming stage in FIG. 5, which shows the relation between an operating distance and an operating force. After the first deforming section 15E deforms, when a further pressing force is applied, the second deforming section 15A of thin wall conical section of the elastic element 15 buckles to deform, thereby creating a click feel.

Figure 4:
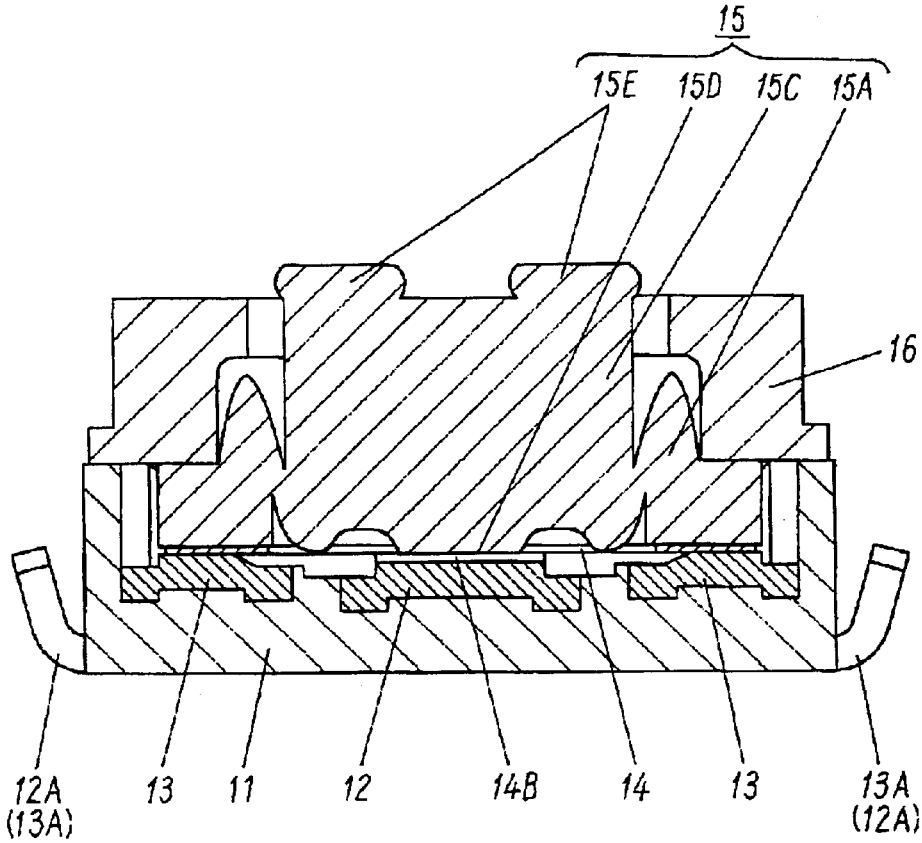
FIG. 4 is a front sectional view of the push switch according to the first embodiment.

The lower end side of the drooping section 15D at the inside of the second deforming section 15A pushes the tongue 14B of the movable contact point 14 down to have the tongue 14B contact with the central fixed contact 12 on the bottom of the switch case 11. As a result, the central fixed contact 12 and outside fixed contacts 13, that is, the connection terminals 12A and 13A conduct with each other, and the switch is turned on, as shown in FIG. 4. The stroke from the beginning of deformation of the second deforming section 15A in the thin wall conical section until the switch is turned on corresponds to the second deforming stage shown in FIG. 5.

When the pressing force on the elastic element 15 is removed, the elastic element 15 and movable contact 14 return to the initial state shown in FIG. 1 by their own elastic restoring force, and the switch is turned off.

Figure 6:
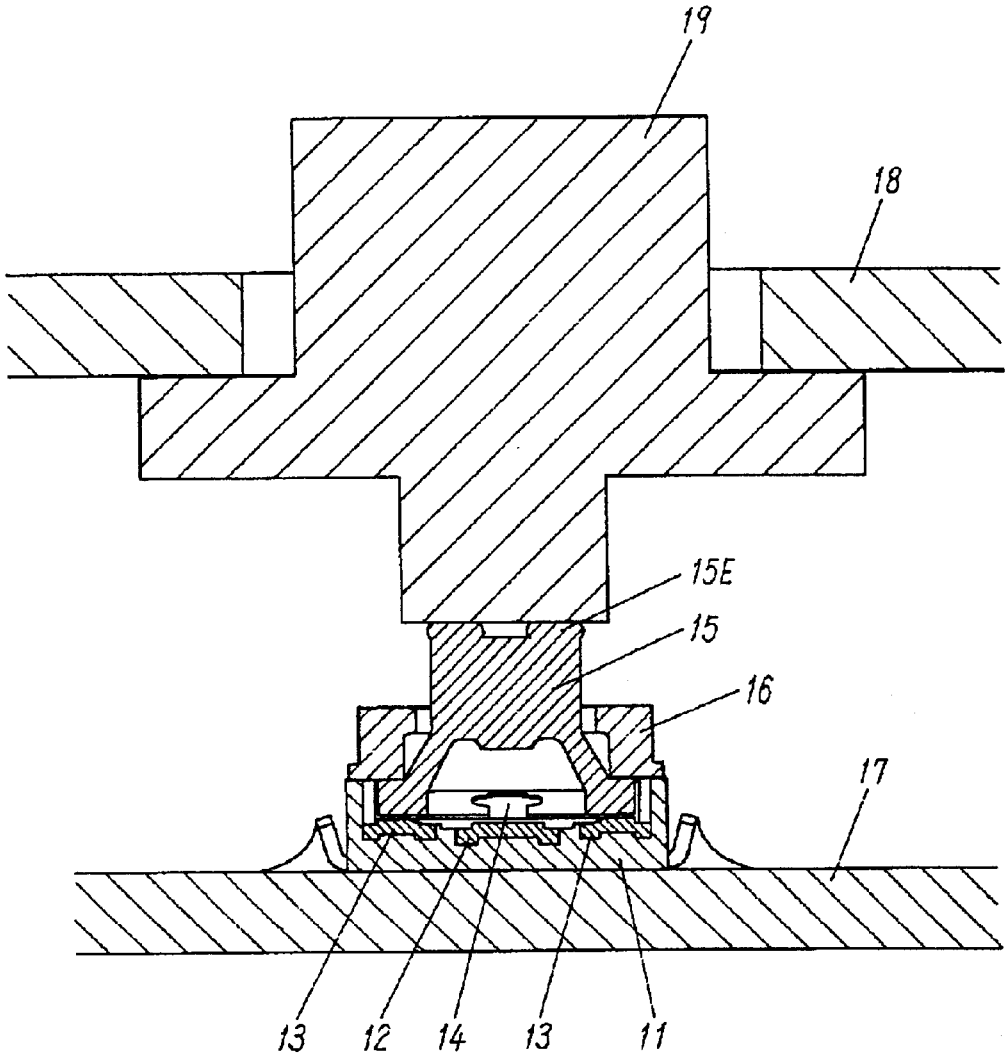
FIG. 6 is a sectional view of the push switch installed in an electronic appliance according to the first embodiment.

FIG. 6 is a sectional view of the push switch according to the embodiment installed in an electronic appliance. Being turned off, the push switch is disposed, so that the elastic element 15 may be positioned immediately beneath an operation button 19 provided in a case 18 of the electronic appliance.

A switch mounting interval between the upper side of the wiring board 17 on which the push switch is installed and the lower side of the operation button 19 varies according to dimension or combination state of the components of the electronic appliance. In this embodiment, the switch mounting interval is slightly smaller than the height of the push switch. Therefore, the push switch is installed so that the first deforming section 15E in the upper part of the elastic element 15 abuts on the lower side of the operation button 19, being deforming. This dimensional arrangement absorbs fluctuation of the switch mounting interval with the first deforming section 15E provided in the upper side of the bar section 15C of the elastic element 15, thus eliminating looseness of the operation button 19 of the electronic appliance.

If the switch mounting interval is smaller than the maximum deforming dimension of the first deforming section 15E of the elastic element 15, the second deforming section 15A of the conical section of the elastic element 15 does not deform. This prevents the handling feeling of the push switch from being influenced due to excessive pushing of the elastic element 15.

Thus, according to the embodiment, fluctuation due to components of the electronic appliance and their combination can be absorbed, looseness of the operation button 19 does not occur, and a push switch maintaining a favorable operation feeling is obtained.

It is important to set the switch mounting interval properly in consideration of the mounting of the push switch in relation to the wiring board 17.

Figure 7A:
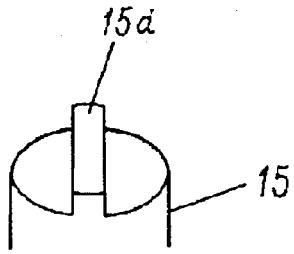
FIG. 7A to FIG. 7J are partial outline perspective views of another push switch according to the first embodiment.
Figure 7B:
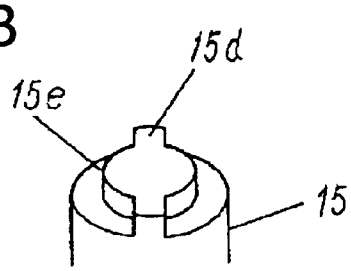
Figure 7C:
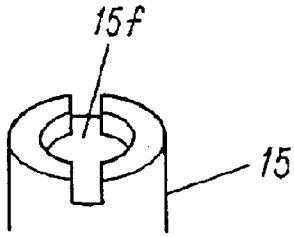
Figure 7D:
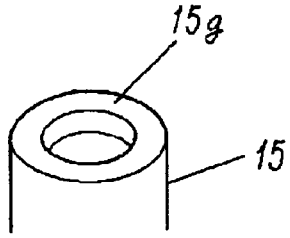
Figure 7E:
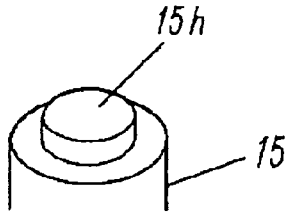
Figure 7F:
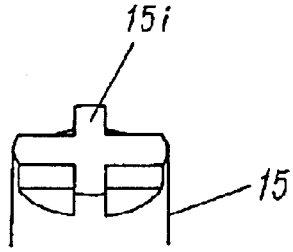
Figure 7G:
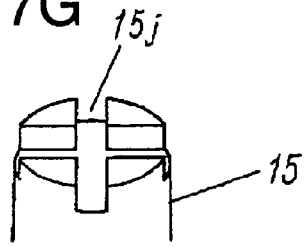
Figure 7H:
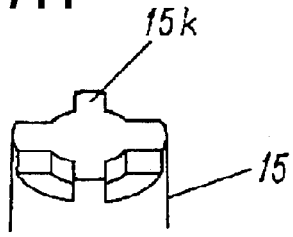
Figure 7I:
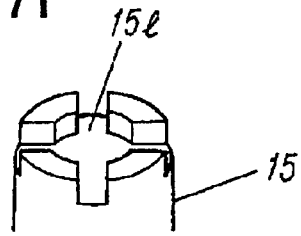
Figure 7J:
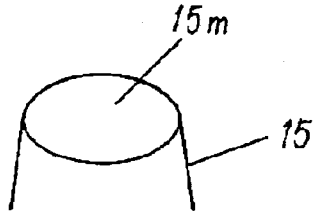

In the foregoing explanation, the first deforming section 15E of the push switch is the bar section 15C having a straight groove in the elastic element 15, but it may be formed as shown in FIG. 7A to FIG. 7J. FIG. 7A shows a straight convex shape 15*d*. FIG. 7B shows a straight convex shape 15*d* having a circular convex part 15*e* at its center. FIG. 7C shows a concave shape 15*f*, a shape reverse to that shown in FIG. 7B. FIG. 7D shows a ring-shaped protruding shape 15*g*. FIG. 7E shows a circular convex part 15*h* only at its center. FIG. 7F shows a cross-shaped convex shape 15*i* symmetrical about its center. FIG. 7G shows a cross concave shape 15*j* reverse to that shown in FIG. 7F. FIG. 7H shows a convex shape 15*k* having cross shape and circular shape. FIG. 71 shows a concave shape 151 reverse to that shown in FIG. 7H. FIG. 7J shows a concentric pointed shape 15*m* in which the bar section becoming smaller in diameter toward its upper side.

These shapes may be combined, and the configuration is not particularly defined as far as the first deforming section maintains a specified deforming amount and deforms elastically with a force smaller than a force for deforming the second deforming section.

(Exemplary Embodiment 2)

Figure 8:
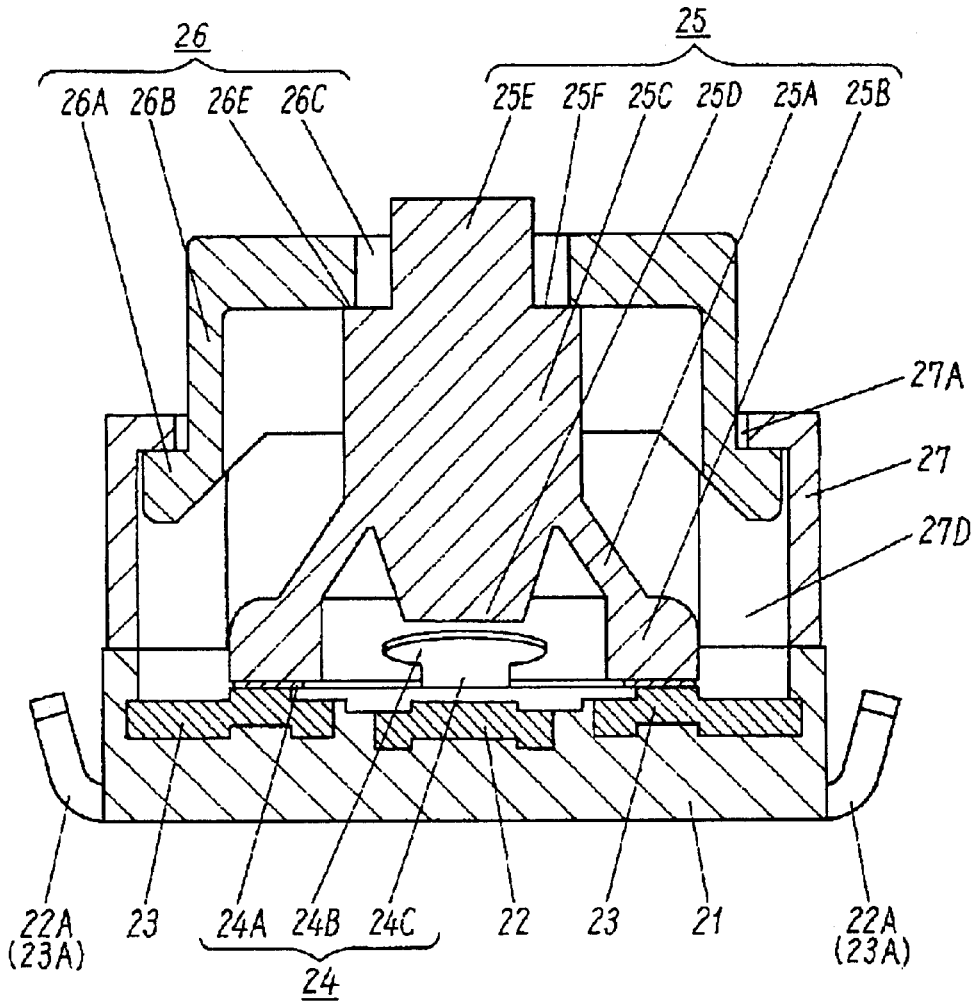
FIG. 8 is a front sectional view of a push switch according to a second exemplary embodiment of the invention.
Figure 9:
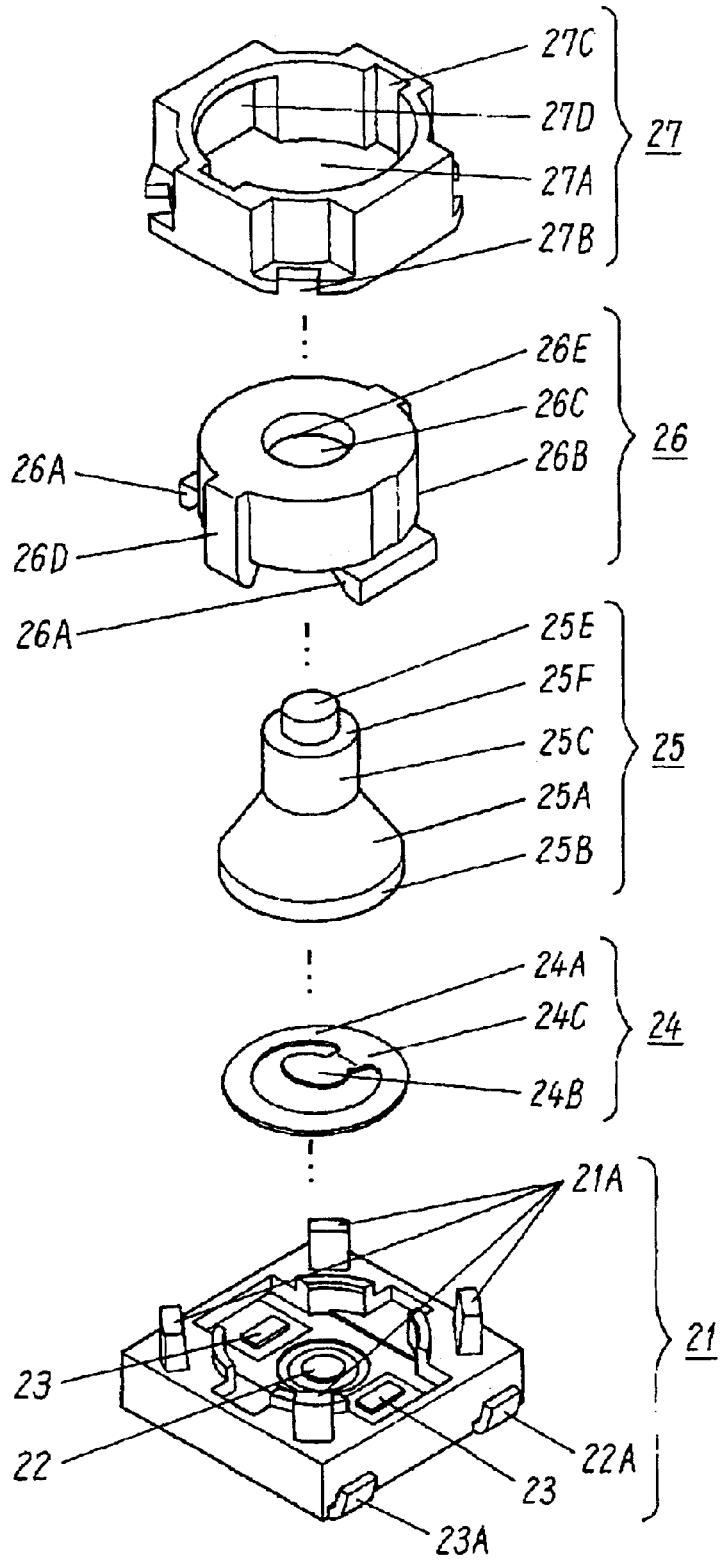
FIG. 9 is a perspective exploded view of the push switch according to the second embodiment.

FIG. 8 is a front sectional view of a push switch accorfing to a second exemplary embodiment of the invention, and FIG. 9 is an exploded perspective view of the switch. In an inner bottom of a central concave portion of a square switch case 21 made of insulating resin, a central fixed contact 22 and two outside fixed contacts 23 is disposed at symmetrical positions, being fixed by insert molding while exposing nearly at the same height. Connection terminals 22A, 23A communicating with the fixed contacts 22 and 23, respectively, are drawn out outward of a side wall of the case, and a columnar crimping bump 21A is provided at the upper side corner.

In a movable contact 24, similarly to the contact point 14 of embodiment 1, a periphery 24A of a circular ring shape is disposed on the outside fixed contact 23 of the switch case 21, and a tongue 24B folded upward at a linkage 24C in this state and disposed in the center of the outer periphery 24A. The tongue 24B faces the central fixed contact 22 at a certain interval.

An elastic element 25 made of insulating elastic material includes an upper conical section 25C and a thin wall conical section opening downward formed integrally in its lower part. The elastic element 25 has a step 25F in the middle position of the bar section 25C. From the step 25F, its upper part has a circular convex shape having a slightly smaller diameter than the bar section 25C.

The circular convex portion functions as a first deforming section 25E, and the conical section in the lower part of the bar section 25C functions as a second deforming section 25A. When the elastic element 25 is pushed down and deformed, the first deforming section 25E in the upper part of the bar section 25C is elastically compressed and deformed, and then the second deforming section 25A of thin wall conical section buckles to deform. That is, the diameter and height of the circular convex portion are defined so that a force for deforming the first deforming section 25E may be smaller than a force for deforming the second deforming section 25A.

Similarly to embodiment 1, the elastic element 25 has a drooping section 25D in the inside of the conical section, and the lower end portion 25B of the conical section is disposed on the periphery 24A of the movable contact 24. In this configuration, the drooping section 25D faces the tongue 24B of the movable contact 24 at a certain interval.

An operation element 26 is a resin-made box opening downward having a central hole 26C in the center of its upper side. The operation element 26 has two engaging portions 26D each having a convex shape in a vertical direction at a specified width outward of a side wall 26B and stopping pawls 26A for preventing the element from slipping out. The pawls are provided at the lower end of the side wall 26B of positions orthogonal to the engaging portions 26D at symmetrical positions about the center of the central hole 26C.

The operation element 26 is disposed on the elastic element 25, having the first deforming section 25E of the elastic element 25 project upward through the central hole 26C in the center of its upper side. The peripheral lower side 26E of the central hole 26C pushes the step 25F of the bar section 25C of the elastic element 25.

The size of the central hole 26C of the operation element 26 is defined, so that the first deforming section 25E of the elastic element 25 may not contact with the inner peripheral wall of the central hole 26C even if being elastically compressed to be positioned flush with the upper side of the operation element 26.

In a tubular resin-made linkage 27, the upper part of the operation element 26 projects upward through a center hole 27A. A lower crimping notch 27B of the linkage 27 is crimped and fixed to the crimping protrusion 21A at the upper side corner of the switch case 21, and is fitted to the switch case 21.

The linkage 27 has, at its inner wall, a groove 27C penetrating in the vertical direction corresponding to the engaging portion 26D of convex shape provided in the side wall 26B of the operation element 26. The engaging portion 26D is engaged with the groove 27C without looseness, thus allowing the operation element 26 to be smoothly guided vertically. In an ordinary state in which a pushing force is not applied as shown in FIG. 8, the stopping pawl 26A of the operation element 26 stops at the lower side around the center hole 27A, and this prevents the operation element 26 from slipping out.

An engaging area between the groove 27C and engaging portion 26D is not illustrated in the sectional view in FIG. 8.

In the side wall downward from the stopping pawl 26A of the linkage 27, a recess 27D is formed toward radially. When moving downward of the operation element 26, the stopping pawl 26A can move along recess 27D without obstacle. At the side of the recess 27D, the stopping pawl 26A moves while having its side guided. That is, the engaging portions 26D and stopping pawl 26A of the operation element 26 are regulated in their movement in the vertical direction by the groove 27C and recess 27D, and prevents the operation element 26 from rotation and upward slip-out.

An operation of the push switch according to this embodiment will be explained.

Figure 10:
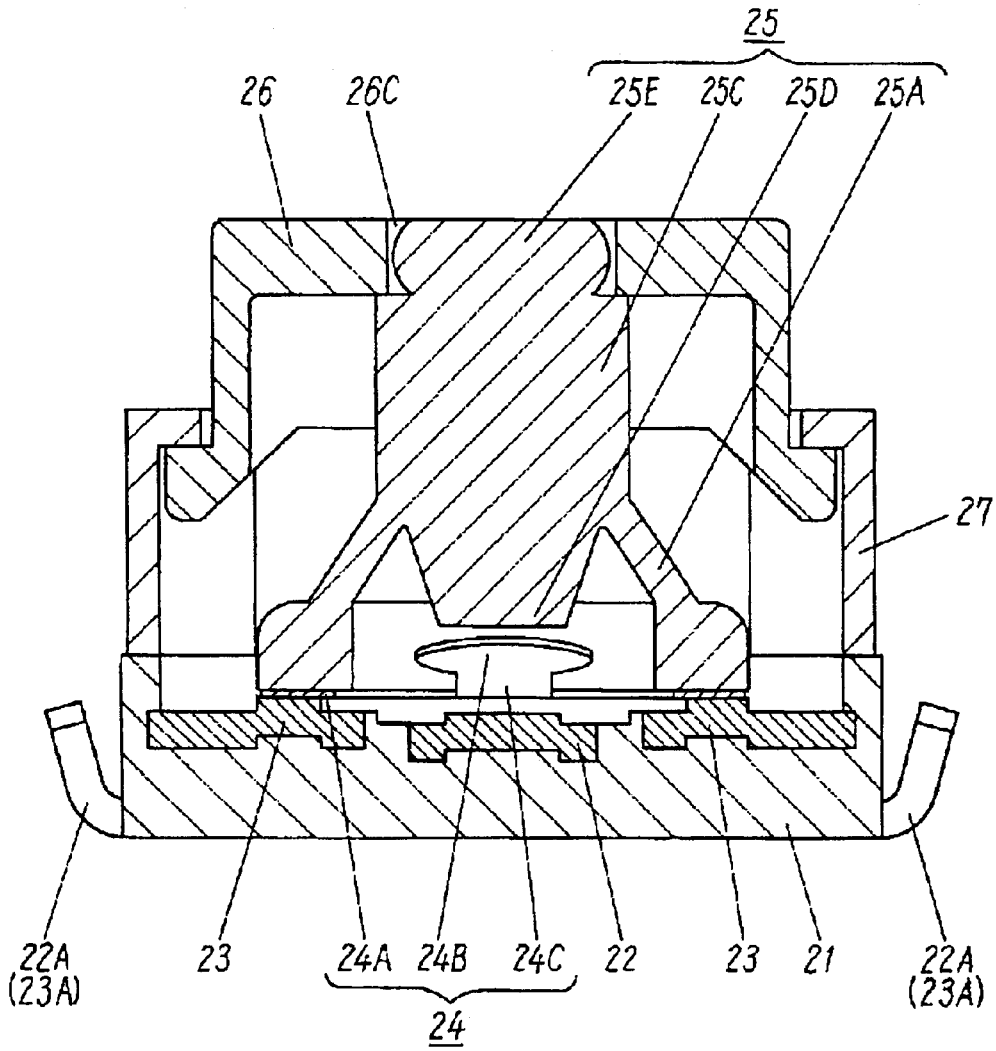
FIG. 10 is a front sectional view of the push switch according to the second embodiment.

In an ordinary state in which a pushing force is not applied as shown in FIG. 8, the first deforming section 25E of the elastic element 25 projecting through the upper side of the operation element 26 is pushed by a pushing force applied through an operation button (not shown) of an electronic appliance. The button is slightly larger than the central hole 26C of the operation element 26. As a result, as shown in FIG. 10, the first deforming section 25E is compressed and deforms elastically until the push button abuts on the upper side of the operation element 26. The deforming at this moment corresponds to the first deforming stage in FIG. 5.

Upon being further pushed down, the operation element 26 is pushed by the operation button, and the operation element 26 straightly moves down while the engaging portions 26D and stopping pawl 26A are guided by the groove 27C and side of the recess 27D. Simultaneously, the peripheral lower side 26E of the central hole 26C applies a downward pushing force to the step 25F of the bar section 25C of the elastic element 25.

Figure 11:
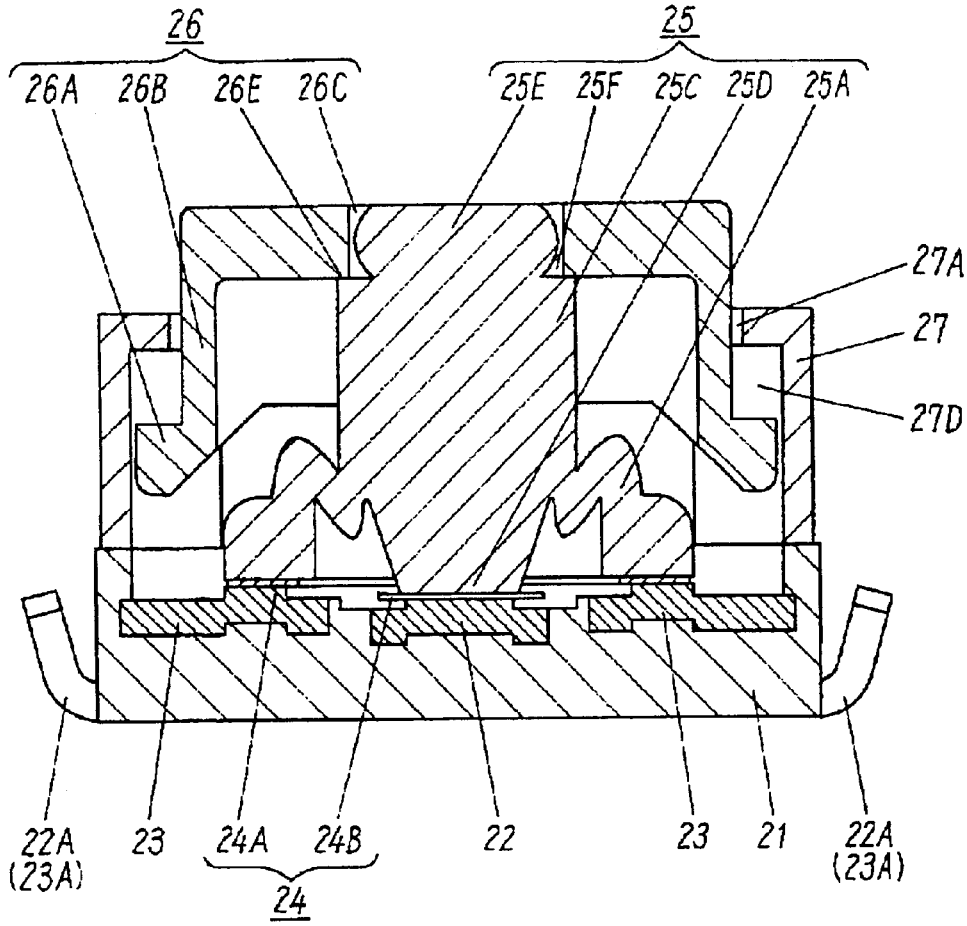
FIG. 11 is a front sectional view of the push switch according to the second embodiment.

When the pushing force to the step 25F exceeds a predetermined value, the second deforming section 25A in the thin wall conical section of the elastic element 25 buckles to deform, and generates a click feel. Simultaneously, the lower end side of the drooping section 25D in the inside pushes the tongue 24B of the movable contact point 24 down to have the tongue contact with the central fixed contact 22 on the switch case 21. Then, the central fixed contact 22 and outside fixed contacts 23, that is, the connection terminals 22A and 23A conduct with each other, thus having the switch turned on, as shown in FIG. 11.

Figure 5:
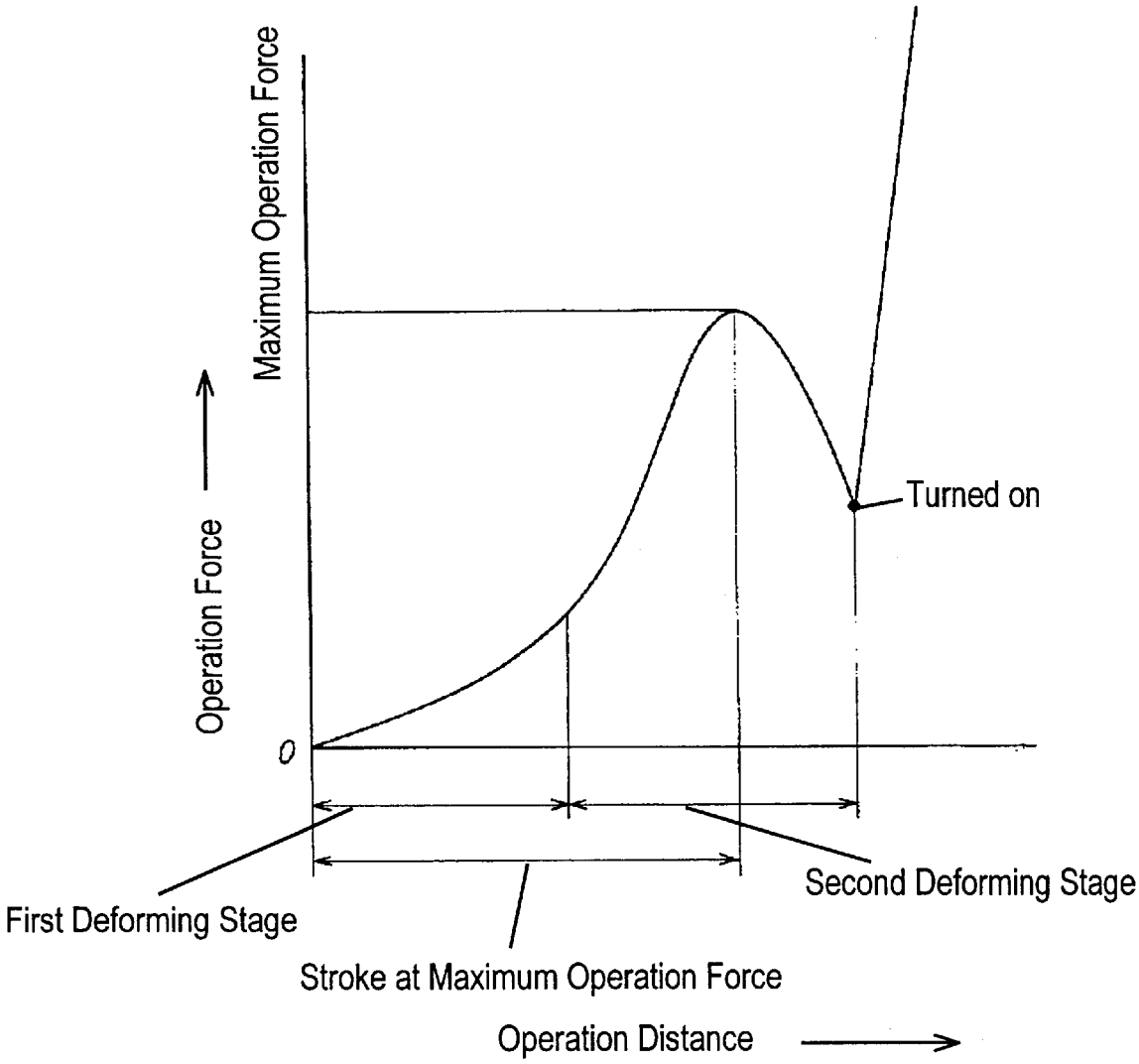
FIG. 5 is a diagram showing the relation between an operating distance and an operating force for the push switch according to the first embodiment.

In this explanation, the stroke from beginning of the deformation of the second deforming section 25A until the switch is turned on corresponds to the second deforming stage in FIG. 5.

When the switch according to this embodiment is mounted, similarly to embodiment 1, in consideration of fluctuations of dimensions and combination of components of the electronic appliance, only the first deforming section 25E of the elastic element 25 deforms slightly. This arrangement has the operation button of the electronic appliance positioned at a predetermined clearance against the operation element 26. This eliminates looseness of the operation button.

Since the first deforming section 25E is deformed by a smaller force than the second deforming section 25A of the conical section of the elastic element 25, the push switch can be installed while having a desired operation feeling.

Thus, the switch of the embodiment, similarly to embodiment 1, can be installed while absorbing fluctuations of components of the electronic appliance and their combination, is prevented from looseness of operation button, and generates a favorable operation feeling.

If the operation button of the electronic appliance has a hinge shape and is pressed obliquely in the switch of the embodiment, the operation element 26 is guided by the linkage 27, and can be moved up and down smoothly. Therefore, the switch generates a favorable feeling stably at its manipulation.

Figure 12:
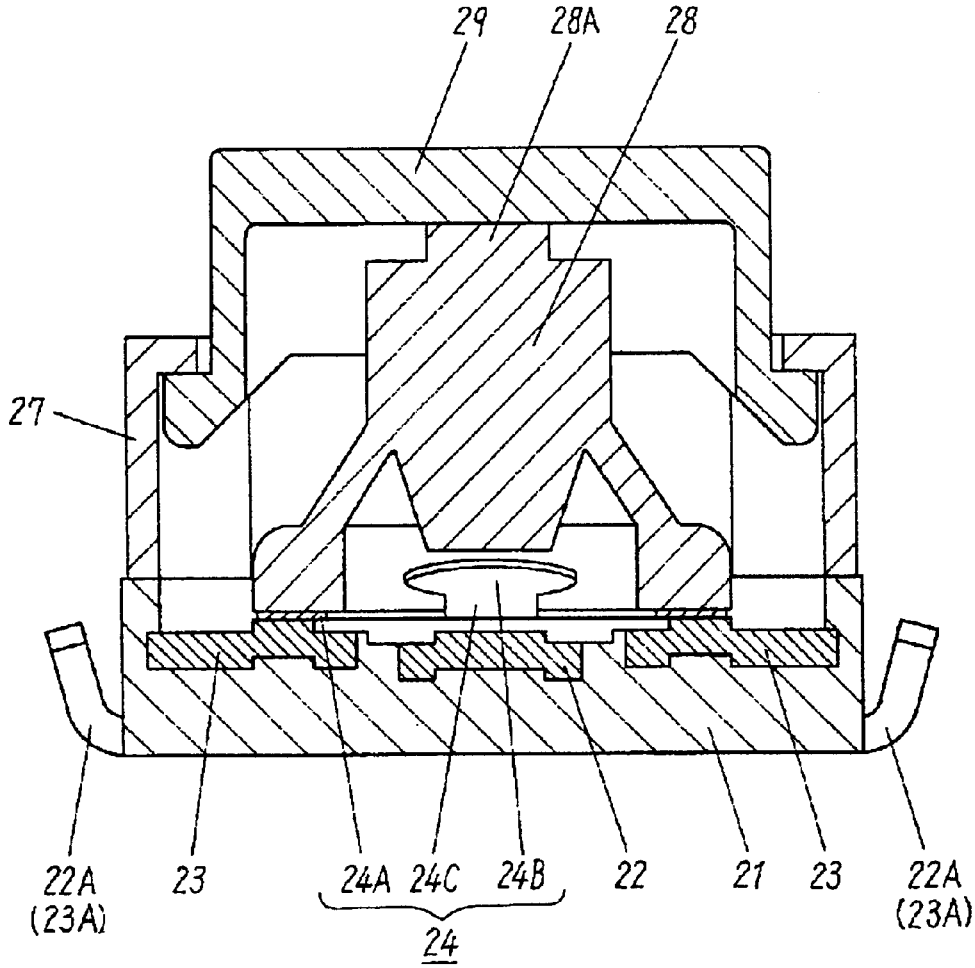
FIG. 12 is a front sectional view of another push switch according to the second embodiment.

According to the embodiment, the first deforming section 25E of the elastic element 25 projects upward through the central hole 26C of the operation element 26. However, as shown in a sectional view of another switch in FIG. 12, the upper side of an elastic element 28 may be covered with an operation element 29. This switch can be installed, while having only a first deforming section 28A deform slightly. At this moment, a silencing measure may preferably be employed for its manipulation.

Figure 13:
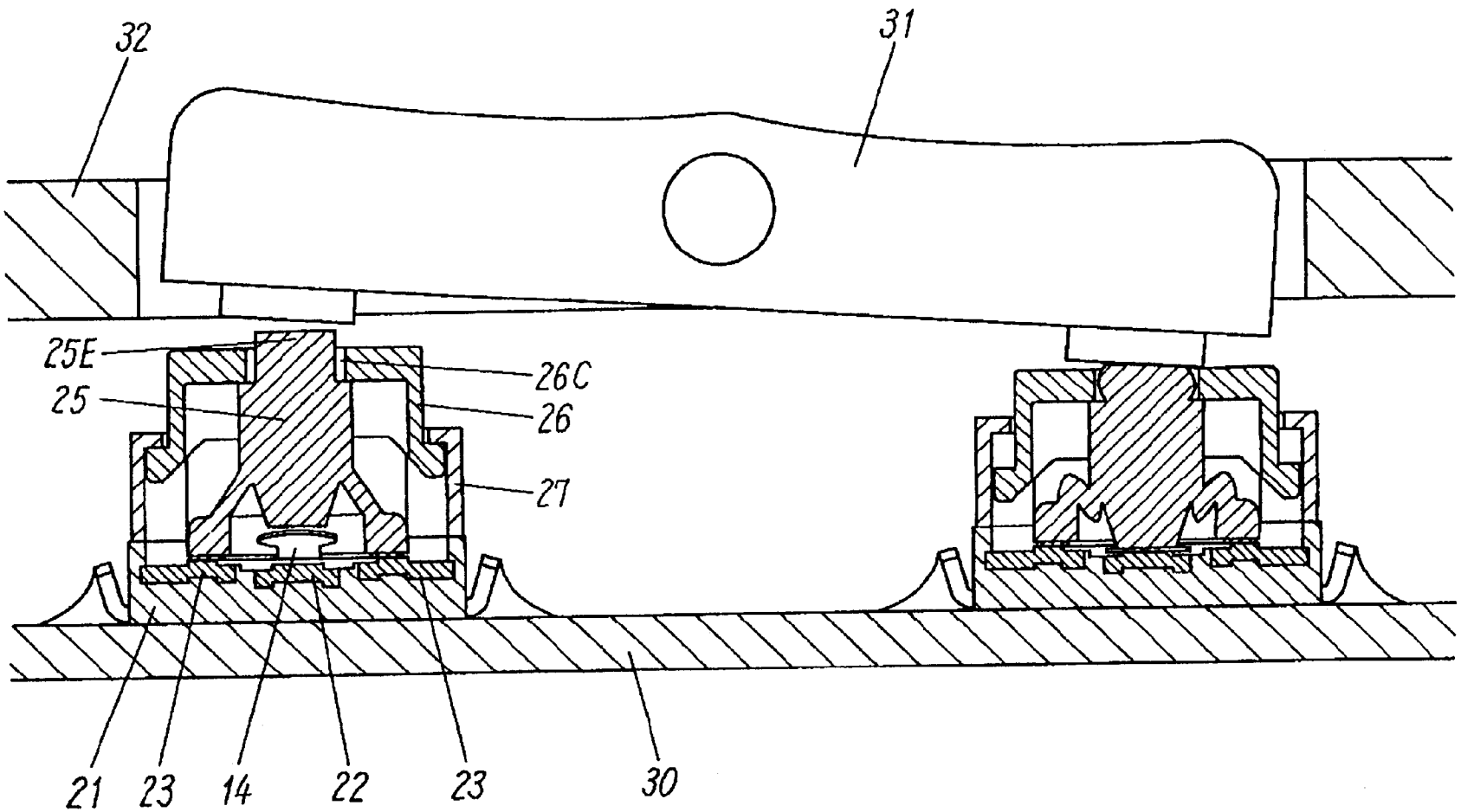
FIG. 13 is a front sectional view of the push switch installed in an electronic appliance according to the second embodiment.
Figure 14:
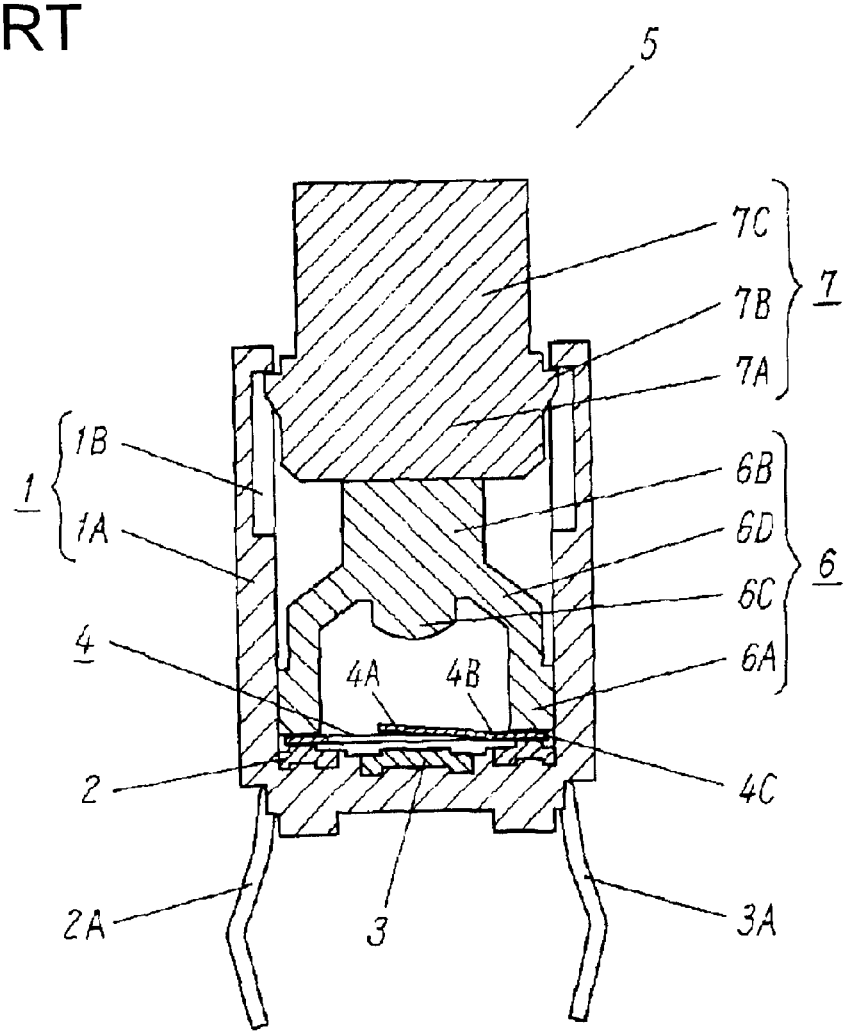
Fig. 14 PRIOR ART
FIG. 14 is a front sectional view of a conventional push switch.
Figure 15:
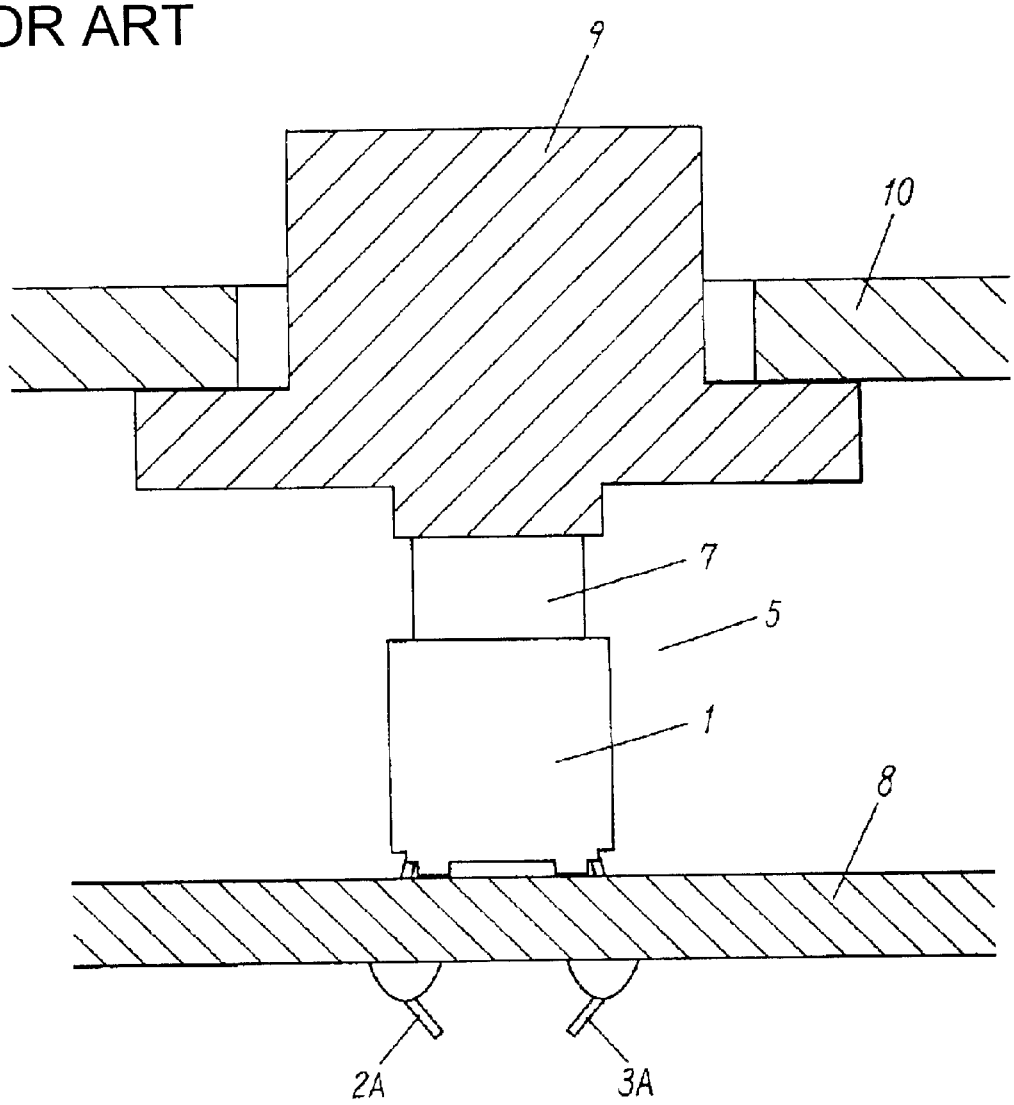
Fig. 15 PRIOR ART
FIG. 15 is a front view of the conventional push switch installed in an electronic appliance.

The push switch of the embodiment can be used in a operation unit for telephoto imaging operation or wide-angle imaging operation at a zoom operation unit of a video camera, as shown in a front view of the switch installed in an electronic appliance shown in FIG. 13.

In this case, two push-ON switch are arranged and soldered on a wiring board 30, and an operation button 31 of seesaw action for pushing the push switches is provided thereon in a case 32 of the electronic appliance.

In this case, when changing over from telephoto imaging operation to wide-angle imaging operation, or from wide-angle imaging operation to telephoto imaging operation, the lower side of the operation button 31 collides against an operation plane of the push switch. This generates a colliding noise, which is recorded together with an image. In the push switch of the embodiment shown in FIG. 8, the first deforming section 25E in the upper part of the elastic element 25 projects to the upper part of the operation element 26. Therefore, the lower side of the operation button 31 collides against the first deforming section 25E of the elastic element 25, so that the first deforming section 25E functions as a shock absorber. This prevents the colliding noise from being generated. Even if the operation button 31 is pushed obliquely to press the push buttons, the switch of the embodiment assures a smooth and favorable operation since the operation element 26 moves up and down smoothly.

Thus, the push switch of the embodiment does not require a cushion member adhered to the upper or lower side of the operation button, the colliding noise can be eliminated easily, and its operation efficiency is excellent.

What is claimed is:

1. A push switch comprising:

an insulating switch case, first and second fixed contacts exposed on said switch case, a movable contact including:

a periphery disposed on said first fixed contact; and a tongue made of elastic metal linked to said periphery, said tongue facing said second fixed contact at a predetermined interval;

an elastic member including:

a bar section having a first deforming section deforming elastically with a pushing force;

a conical section opening and pushing said periphery at an end thereof; and a drooping section provided inside of said conical section for pressing said tongue; and an operation element for pushing said first deforming section of said elastic member towards said conical section prior to actuation of said push switch;

wherein said first deforming section deforms with said pushing force, and then, said conical section deforms elastically while said elastic member deforms elastically.

2. The push switch of claim 1, wherein said first deforming section has a portion at least one of an undulated portion and a groove portion provided in said bar section.

3. The push switch of claim 1, further comprising connection terminals drawn out of said first and second fixed contacts, respectively.

4. The push switch of claim 1, wherein said first and second fixed contacts are fixed by insert molding in said switch case.

5. The push switch of claim 1, further comprising a cover having a hole through which said bar section projects, said cover being fixed to said switch case.

6. The push switch of claim 5, wherein said cover pushes said end of said conical section to allow said periphery of said movable contact to contact elastically with said first fixed contact.

7. The push switch of claim 1, further comprising:

a linkage having a hole, being fixed to said switch case; and an operation element for holding said elastic element, said operation element being guided by said linkage and coupled movably to said linkage, said operation element projecting through said hole of said linkage.

8. The push switch of claim 7, wherein said bar section further has a step provided in a middle portion thereof, wherein said first deforming section is provided in a direction opposite to said conical section from said step, and wherein said operation element has a hole through which said first deforming section projects, and holds said step at a periphery of said hole of said operation element.

9. A push switch comprising:

an insulating switch case, first and second fixed contacts exposed on said switch case, a movable contact including:

a periphery disposed on said first fixed contact; and a tongue made of elastic metal linked to said periphery, said tongue facing said second fixed contact at a predetermined interval; and an elastic member including:

a bar section having a first deforming section deforming elastically with a pushing force;

a conical section opening and pushing said periphery at an end thereof;

a drooping section provided inside of said conical section for pressing said tongue;

a linkage having a hole, being fixed to said switch case; and an operation element for holding said elastic element, said operation element being guided by said linkage and coupled movably to said linkage, said operation element projecting through said hole of said linkage;

wherein said first deforming section deforms with said pushing force, and then, said conical section deforms elastically while said elastic member deforms elastically.

10. The push switch of claim 9, wherein said first deforming section has a portion at least one of an undulated portion and a groove portion provided in said bar section.

11. The push switch of claim 9, further comprising connection terminals drawn out of said first and second fixed contacts, respectively.

12. The push switch of claim 9, wherein said first and second fixed contacts are fixed by insert molding in said switch case.

13. The push switch of claim 9, wherein said bar section further has a step provided in a middle portion thereof;

wherein said first deforming section is provided in a direction opposite to said conical section from said step; and wherein said operation element has a hole through which said first deforming section projects and holds said step at a periphery of said hole of said operation element.

* * * * *